United States Patent [19]

Kuhlman, Jr.

[11] Patent Number: 4,615,394

[45] Date of Patent: Oct. 7, 1986

[54] INVERSE DIFFERENTIAL CASING CEMENTING FLOAT VALVE

[75] Inventor: Robert D. Kuhlman, Jr., Duncan, Okla.

[73] Assignee: Halliburton Company, Duncan, Okla.

[21] Appl. No.: 729,592

[22] Filed: May 2, 1985

[51] Int. Cl.[4] ..... E21B 34/06

[52] U.S. Cl. ..... 166/327; 166/325

[58] Field of Search ..... 166/325–328, 166/321, 319, 386, 285; 137/512, 512.3

[56] References Cited

U.S. PATENT DOCUMENTS

| | | | |
|---|---|---|---|
| 2,751,021 | 6/1956 | Muse | 166/320 |
| 2,768,695 | 10/1956 | Althouse, Jr. et al. | 166/327 |
| 2,848,053 | 8/1958 | Curry | 166/325 |
| 2,921,601 | 1/1960 | Fisher, Jr. | 166/321 X |
| 2,973,006 | 2/1961 | Nelson | 166/326 |
| 3,072,145 | 1/1963 | Nelson | 137/846 |
| 3,120,269 | 2/1964 | Evans et al. | 166/318 X |
| 3,148,731 | 9/1964 | Holden | 166/318 X |
| 3,220,481 | 11/1965 | Park | 166/325 X |
| 3,275,080 | 9/1966 | Nelson et al. | 166/325 |
| 3,289,769 | 12/1966 | Nelson et al. | 166/326 |
| 3,292,707 | 12/1966 | Nelson et al. | 166/325 |
| 3,481,397 | 12/1969 | Baker | 166/320 |
| 4,474,241 | 10/1984 | Freeman | 166/325 X |

*Primary Examiner*—Stephen J. Novosad
*Assistant Examiner*—Thuy M. Bui
*Attorney, Agent, or Firm*—James R. Duzan

[57] ABSTRACT

The inverse differential fill-up casing cementing float valve comprises an annular valve housing, back pressure valve assembly, a first differential pressure check valve assembly, a second differential pressure check valve assembly, and cement filler material to retain the valve assemblies within the valve housing.

6 Claims, 2 Drawing Figures

INVERSE DIFFERENTIAL CASING CEMENTING FLOAT VALVE

BACKGROUND OF THE INVENTION

This invention relates to an inverse differential fill-up casing cementing float valve used in the cementing of casing in offshore oil and gas wells.

When running large diameter well casing from offshore drilling rigs into an open well bore to be cemented therein, strong sea currents may be encountered which may force the well casing away from its desired placement point in the open well bore in the sea floor. Since the well casing is usually of a large diameter and the well casing string of substantial length, as well as being buoyant, the ocean currents may push the casing far enough from the open well bore to create a problem.

To overcome this problem the well casing is filled with drilling mud with the drilling mud being kept inside the casing until the casing has been successfully guided into the open well bore. By filling the well casing with drilling mud during this process, the drilling mud inside the casing adds to the mass and weight of the casing string thereby making it more difficult for the ocean currents to displace or move the casing string.

STATEMENT OF THE INVENTION

To facilitate the filling of casing string with drilling mud the present invention, an inverse differential fill-up casing cementing float valve is used on the end of the casing string to be inserted and cemented into the well bore. The inverse differential fill-up casing cementing float valve of the present invention is used to retain the drilling mud in the casing string until a predetermined differential pressure exists between the interior of the casing string and the fluid in the well bore or the surrounding sea water during the running of the casing string and during circulation prior to the cementing of the casing string in the well bore. The inverse differential fill-up casing cementing float valve of the present invention must further function as a cementing check valve during the cementing of the casing string in the well bore.

The present invention of an inverse differential fill-up casing cementing float valve comprises an annular valve housing, back pressure valve assembly, a first differential pressure check valve assembly, a second differential pressure check valve assembly, and cement filler material to retain the valve assemblies within the valve housing.

BRIEF DESCRIPTION OF THE DRAWINGS

The advantages of the present invention will be better understood from the following detailed specification taken in conjunction with the drawings wherein.

DETAILED DESCRIPTION OF THE INVENTION

Figure 1:
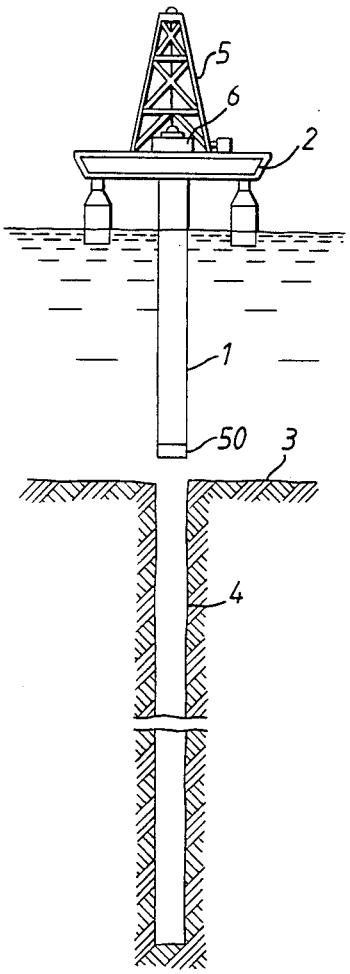
FIG. 1 is a drawing of a typical offshore drilling rig running a casing string therefrom having the present invention installed on one end thereof.

Referring to FIG. 1, the present invention of an inverse differential fill-up casing cementing float valve 50 is shown on casing string 1 for use in an offshore oil or gas well.

In FIG. 1, a floating drilling rig or work station 2 is centered over a submerged oil or gas well located in the sea floor 3 having a bore hole 4 therein. The drilling rig 2 has a derrick 5 and a hoisting apparatus 6 for raising and lowering tools to drill, test and complete the oil or gas well. After the casing string 1 having the float valve 50 of the present invention thereon is lowered into the borehole 4, the casing string 1 is cemented therein by pumping a cement slurry down the interior of the casing string 1, out through the float valve 50 and up the annulus between the casing string 1 and the borehole or well bore 4 thereby filling the same to the sea floor 3.

Figure 2:
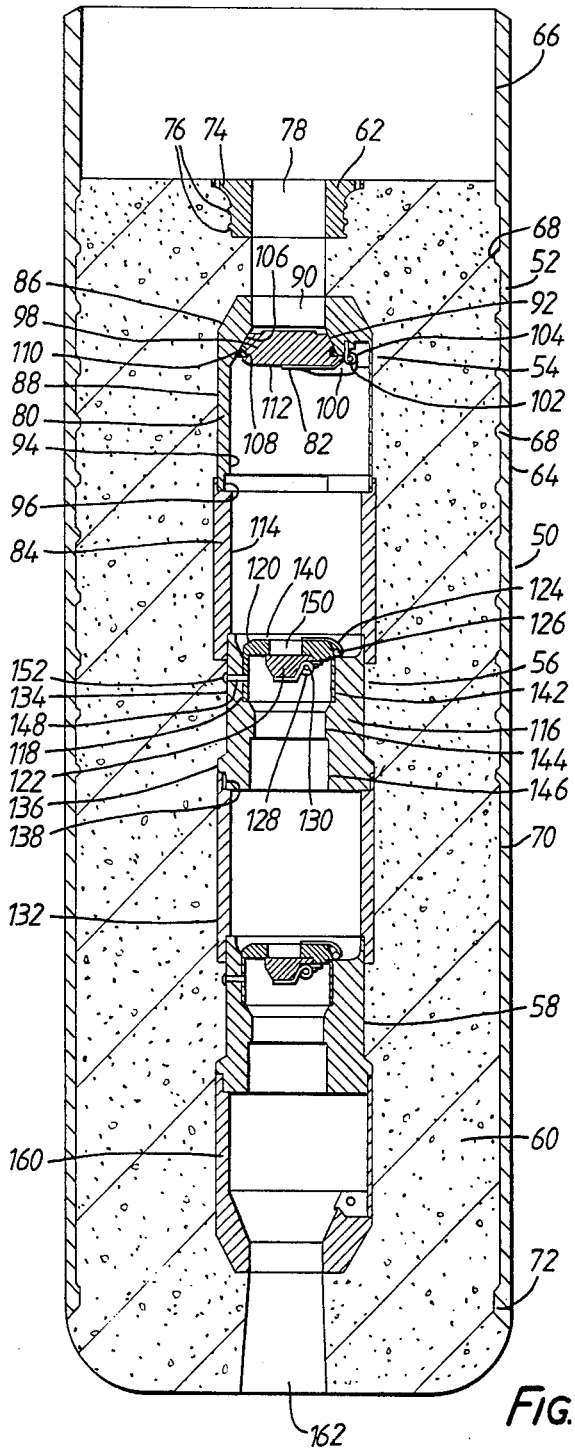
FIG. 2 is a cross-sectional of the present invention of an inverse differential fill-up casing cementing float valve.

Referring to FIG. 2, the inverse differential fill-up casing cementing float valve 50 of the present invention is shown in cross-section.

The inverse differential fill-up casing cementing float valve 50 comprises an annular valve housing 52, back pressure valve assembly 54, a first differential pressure check valve assembly 56, a second differential pressure check valve assembly 58 and cementitious filler material 60 to retain the valve assemblies within the valve housing 52. The float valve 50 further includes insert collar 62 therein retained within the cementitious material 60.

The annular valve housing 52 comprises an elongated annular member having, on the exterior thereof, cylindrical surface 64 and, on the interior thereof, first bore 66, a plurality of first annular ribs 68, second bore 70 and second annular rib 72 on one end thereof.

The insert collar 62 comprises a cylindrical member having, on the exterior thereof, annular rim 74 and a plurality of annular ribs 76 thereon and, on the interior, bore 78.

The back pressure valve assembly 54 comprises annular valve housing 80, flapper valve assembly 82 and connector housing 84.

The annular valve housing 80 comprises an annular cylindrical member having, on the exterior thereof, frusto-conical annular surface 86 and cylindrical surface 88 and, on the interior thereof, first bore 90, frusto-conical annular surface 92, second bore 94 and third bore 96.

The flapper valve assembly 82 comprises valve body 98, valve body hinge arm 100, hinge pin 102 and valve spring 104.

The valve body 98 comprises a circular member having a frusto-conical annular exterior surface 106 thereon which is complementary to frusto-conical annular surface 92 of valve housing 80 and an annular recess 108 in the exterior having, in turn, annular elastomeric sealing member 110 therein which sealingly engages frusto-conical annular surface 92 of valve housing 80 when valve body 98 is in engagement therewith.

The valve body hinge arm 100 is attached to the bottom surface 112 of valve body 98 and is retained within valve housing 80 by hinge pin 102 engaging a portion of the valve housing 80 and one end of arm 100. The valve body 98 is resiliently biased into engagement within valve housing 80 by valve spring 104 which has a portion, in turn, bearing against valve body hinge arm 100.

The connector housing 84 comprises an elongated annular member having one end connected to the valve housing 80 and a bore 114 therethrough.

The back pressure valve assembly 82 is retained within valve housing 52 by cementitious filler material 60. In operation, the back pressure valve assembly 54 allows flow in the downward direction therethrough by the fluid opening resiliently biased valve body 98 from valve housing 80 while preventing fluid flow from below the valve body 98 to act as a check valve by the fluid causing the valve body 98 to more tightly engage the valve housing 80.

The first differential pressure check valve assembly 58 comprises differential valve housing 116, insert housing 118, primary valve body 120, secondary valve body 122, primary valve spring 124, primary hinge pin 126, secondary valve spring 128, secondary hinge pin 130 and connector housing 132.

The differential valve housing 116 comprises an elongated annular cylindrical member having, on the exterior thereof, first cylindrical surface 134, second cylindrical surface 136 and third cylindrical surface 138 and, on the interior thereof, first bore 140, second bore 142, third bore 144 and fourth bore 146. The differential housing 116 is further formed having an aperture 148 through the wall thereof.

The insert housing 118 comprises a cylindrical member having a cylindrical exterior, cylindrical bore therethrough, aperture in the wall thereof and an attachment hinge on one end thereof.

The primary valve body 120 comprises a circular member having bore 150 therethrough, a hinge portion on the exterior thereof and a hinge portion on the bottom thereof.

The primary valve body 120 is retained on insert housing 118 by primary hinge pin 126 and is resiliently biased into engagement with insert housing 118 by primary valve spring 124.

The secondary valve body 122 comprises a circular member having a hinge portion on the exterior thereof which is movably attached to the hinge portion on the bottom of primary valve body 120 by secondary hinge pin 130 and is biased into engagement with the bottom of primary valve body 120 sealing bore 150 therethrough by secondary valve spring 128.

The insert housing 118 is retained within differential housing 116 by pin 152 which is installed in aperture 148 of differential housing 116 and the aperture in insert housing 118.

The connector housing 132 comprises an elongated cylindrical annular member having a cylindrical exterior, cylindrical bore therethrough and one end connected to differential housing 116.

The first differential pressure check valve assembly 56 is retained within valve housing 52 by cementitious filler material 60. In operation, first differential pressure check valve assembly 56 allows flow in the downward direction therethrough through bore 150 in primary valve body 120 by the fluid causing secondary valve body 122 to open away from primary valve body 120 and allows flow upwardly therethrough by primary valve body 120 being opened by the fluid.

The second differential pressure check valve assembly 58 is of the same construction and operation as first differential check valve assembly 56 except an annular valve housing 160 replaces connector housing 132, the annular valve housing 160 being of the same construction as annular valve housing 80, although any type or shape of connector may be used.

The outlet of the annular valve housing 160 communicates with bore 162 to allow fluid communication with bottom of float valve 50.

In operation, the inverse differential fill-up casing cementing float valve 50 allows the casing string 1 to be filled with drilling mud being retained therein by the first differential 56 and second differential 58 check valve assemblies until such time as the fluid pressure in the casing string 1 is great enough to open the secondary valve members of the check valve assemblies 56 and 58 to allow fluid flow therethrough. When the casing string 1 has been cemented into well bore or borehole 4 by pumping cement therethrough, out the float valve 50 and around the casing string 1, the float valve 50 prevents the flow of cement back into the casing string 1 by back pressure valve assembly 54 acting as a check valve to prevent the flow of fluid upwardly through float valve 50.

Having thus described my invention, I claim:

1. An inverse differential fill-up casing cementing float valve having an inlet thereto and outlet therefrom characterized in that said float valve permits fluid flow therethrough in a first direction upon a predetermined fluid pressure level thereacross and continuously prevents fluid flow therethrough in a second direction, said float valve includes:

an annular float valve housing;

a back pressure valve assembly contained within the annular float valve housing, the back pressure valve assembly being constructed to permit fluid flow therethrough in said first direction upon a predetermined fluid pressure level thereacross and continuously prevent fluid flow therethrough in said second direction;

a first differential pressure check valve assembly connected to the back pressure valve assembly and contained within the annular float valve housing, the first differential pressure check valve assembly being constructed to permit fluid flow therethrough in said first direction upon a predetermined fluid pressure level thereacross and permit fluid flow therethrough in said second direction;

a second differential pressure check valve assembly connected to the first differential pressure check valve assembly and contained within the annular float valve housing, the second differential pressure check valve assembly being constructed to permit fluid flow therethrough in said first direction upon a predetermined fluid pressure level thereacross and permit fluid flow therethrough in said second direction; and cementitious filler material retaining and securing the back pressure valve assembly, the first differential pressure check valve assembly and the second differential pressure check valve assembly within the annular float valve housing, the cementitious filler material providing a fluid flow passage to the inlet of the back pressure valve assembly from the inlet of said float valve and providing a fluid flow passage from the outlet of the second differential pressure check valve assembly to said outlet of said float valve.

2. The inverse differential fill-up casing cementing float valve of claim 1 further characterized in that the back pressure valve assembly includes:

an annular back pressure valve housing retained within the cementitious filler material;

a flapper valve assembly resiliently retained within the annular back pressure valve housing, the flapper valve assembly being constructed to permit fluid flow through the annular back pressure valve housing in said first direction upon a predetermined fluid pressure level thereacross and prevent fluid flow through the annular back pressure valve housing in said second direction; and a connector housing connected to the annular back pressure valve housing and retained within the cementitious filler material.

3. The inverse differential fill-up casing cementing float valve of claim 2 further characterized in that the flapper valve assembly includes:

a flapper valve body which intermittently, sealingly engages a portion of the interior of the annular back pressure valve housing;

a flapper valve body hinge arm having a portion thereof attached to a portion of the flapper valve body;

a flapper valve hinge pin pivotally retaining one end of the flapper valve hinge arm to the annular back pressure valve housing; and a flapper valve spring resiliently biasing the flapper valve body into sealing engagement with the annular back pressure valve housing.

4. The inverse differential fill-up casing cementing float valve of claim 3 further characterized in that the first differential pressure check valve assembly includes:

a first differential valve housing connected to the connector housing of the back pressure valve assembly and retained within the cementitious filler material;

a first insert housing retained within a portion of the first differential valve housing;

a first primary valve body having a portion thereof engaging a portion of the first insert housing and an aperture therethrough;

a secondary valve body engaging the first primary valve body intermittently sealing the aperture in the first primary valve body;

a primary first valve spring engaging a portion of the first primary valve body to resiliently bias the first primary valve body into engagement with a portion of the first insert housing;

a first primary hinge pin rotatably connecting the first primary valve body to the first insert housing;

a secondary first valve spring engaging the secondary valve body resiliently biasing the secondary valve body into sealing engagement with the first primary valve body;

a secondary valve body hinge pin rotatably connecting the secondary valve body to the first primary valve body; and a first differential pressure check valve connector housing having one end thereof connected to the outlet of the first differential valve housing of the back pressure valve assembly and retained within the cementitious filler material.

5. The inverse differential fill-up casing cementing float valve of claim 4 further characterized in that the second differential pressure check valve assembly includes:

a second differential valve housing connected to the first differential pressure check valve connector housing of the first differential pressure check valve assembly and retained within the cementitious filler material;

a second insert housing retained within a portion of the second differential valve housing;

a second primary valve body having a portion thereof engaging a portion of the second insert housing and an aperture therethrough;

a secondary valve body engaging the second primary valve body intermittently sealing the aperture in the second primary valve body;

a primary second valve spring engaging a portion of the second primary valve body to resiliently bias the second primary vavle body into engagement with a portion of the first insert housing;

a second primary hinge pin rotatably connecting the second primary valve body to the second insert housing;

a secondary second valve spring engaging the secondary valve body resiliently biasing the secondary valve body into sealing engagement with the second primary valve body;

a second valve body hinge pin rotatably connecting the secondary valve body of the second differential pressure check valve assembly to the second primary valve body; and a second differential pressure check valve annular valve housing having one end thereof connected to the outlet of the second differential valve housing of the second differential valve housing and retained within the cementitious filler material.

6. The inverse differential fill-up casing cementing float valve of claim 1 further characterized in that the float valve is connected to a casing string to be cemented into a borehole in the sea floor.

* * * * *